United States Patent [19]

Heckathorn

[11] Patent Number: 4,949,893

[45] Date of Patent: Aug. 21, 1990

[54] EMERGENCY STAPLE PACK

[76] Inventor: Carolann M. Heckathorn, 14422 N.W. Hunters Dr., Beaverton, Oreg. 97006

[21] Appl. No.: 395,657

[22] Filed: Aug. 18, 1989

[51] Int. Cl.[5] ..... B25C 5/02; B65D 85/24

[52] U.S. Cl. ..... 227/120; 206/340; 206/467

[58] Field of Search ..... 206/340, 338, 343–346, 206/461, 467, 469, 470, 813, 45.31, 45.34; 229/79; 227/120, 156

[56] References Cited

U.S. PATENT DOCUMENTS

| | | | |
|---|---|---|---|
| 2,266,534 | 12/1941 | Cavanagh | 206/340 |
| 3,184,051 | 5/1965 | Winton | 206/344 X |
| 3,288,280 | 11/1966 | Bostrom | 206/461 |
| 3,302,842 | 2/1967 | MacEachron | 227/120 |
| 3,525,470 | 8/1970 | Carrigan | 229/74 X |
| 3,640,443 | 2/1972 | Itagaki | 227/120 |
| 3,680,759 | 8/1972 | Tyszkiewicz | 227/120 |
| 3,942,640 | 3/1976 | Hellstrom | 206/469 |
| 4,405,073 | 9/1983 | Escalante | 227/120 |
| 4,619,392 | 10/1986 | Won | 227/120 |
| 4,660,717 | 4/1987 | Hofer | 206/338 |

FOREIGN PATENT DOCUMENTS

| | | | |
|---|---|---|---|
| 953047 | 3/1964 | United Kingdom | 227/120 |

*Primary Examiner*—Bryon P. Gehman
*Attorney, Agent, or Firm*—Eugene M. Eckelman

[57] ABSTRACT

A strip of staples is supported on a base portion and confined by an enclosure such as a bubble pack. The base portion has a non-setting adhesive on its lower surface for temporary attachment to a supporting surface, such as a stapler surface. A removable protective layer is provided on the adhesive surface to cover the latter until attachment is to be made to a supporting surface. The enclosure includes a pull tab at one end to pull it away from the base portion for removal of the strip of staples.

2 Claims, 1 Drawing Sheet

EMERGENCY STAPLE PACK

BACKGROUND OF THE INVENTION

Staplers for stapling together papers or other sheets are in common use. These devices generally include a base portion with an anvil surface, a manually operable pusher arm, and a magazine in the pusher arm that holds a strip of staples and that feeds them against the anvil in a stapling process. Each time the strip of staples is exhausted, it is necessary for the operator to stop the job and obtain a new strip from the supply for reloading the stapler magazine. Oftentimes the operator does not wish to interrupt the job for any length of time to locate the staple supply and obtain a new strip for reloading. Also, oftentimes the staple supply is entirely exhausted whereby the job must be stopped altogether.

Prior devices have attempted to overcome this inconvenience by providing an auxiliary staple supply in combination with the stapler. For example, U.S. Pat. Nos. 3,640,443 and 4,619,392 provide stapler constructions that make room for an extra supply of staples. U.S. Pat. Nos. 3,302,842 and 3,680,759 provide stapler constructions which are used in combination with a box-like supply of staples. All of such structures of course require complex compartments or magazines and thus not only add to the cumbersome part of the stapler but also must depart from the inexpensive, simplified stapler structure.

SUMMARY OF THE INVENTION

According to the present invention and forming a primary objective thereof, an inventive concept is provided that satisfies the requirement of having an emergency supply of staples available and that does not make a stapler cumbersome or add to the cost thereof.

A more particular object is to provide an emergency staple pack which includes a durable bubble pack type of enclosure having a non-setting adhesive on its lower surface and in its structure is arranged to be attached piggyback to a surface of the stapler pusher arm for ready use when needed.

In carrying out the invention, the emergency staple pack includes a base portion arranged to support a strip of staples on its upper surface which are held on the base portion by an enclosure such as a bubble pack type of enclosure. The lower surface of the base portion has a non-setting adhesive thereon covered by a removable protective layer, whereby this pack is arranged to have said attachment to a stapler. The enclosure has a pull tab at one end which makes it convenient to open for access to the emergency supply of staples.

The invention will be better understood and additional objects and advantages will become apparent from the following description taken in connection with the accompanying drawings.

DETAILED DESCRIPTION OF A PREFERRED EMBODIMENT

Figure 1:
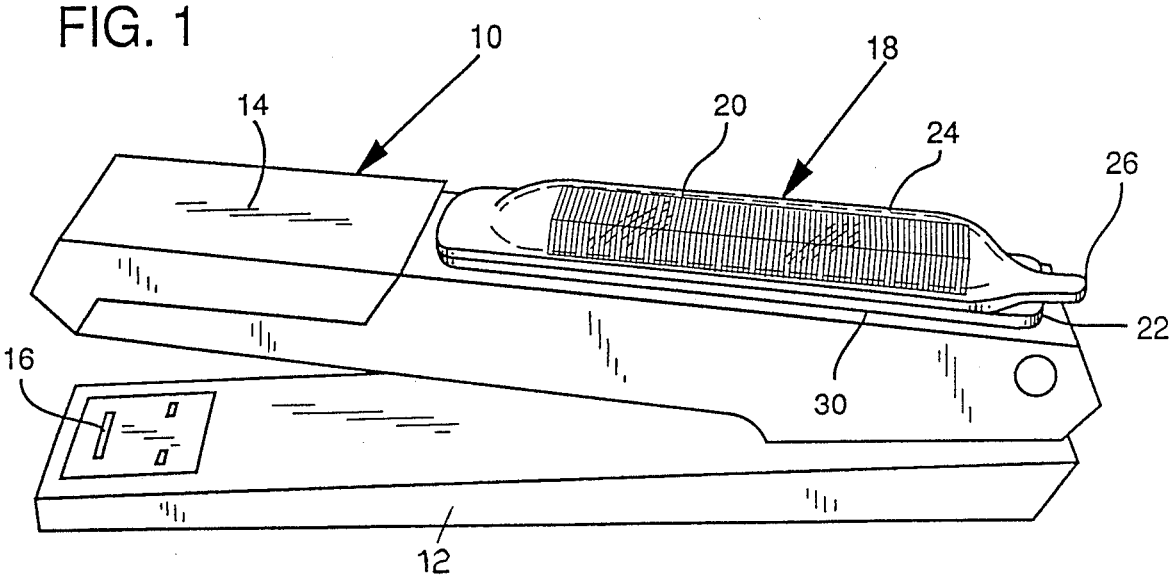
FIG. 1 is a perspective view of a stapler of common use and showing the present invention attached in a piggyback manner to a surface of the stapler.
Figure 2:
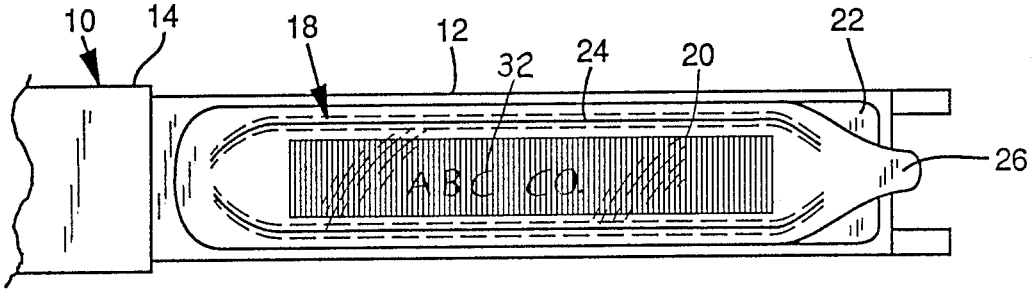
FIG. 2 is a top plan view of the stapler and attached pack.
Figure 3:
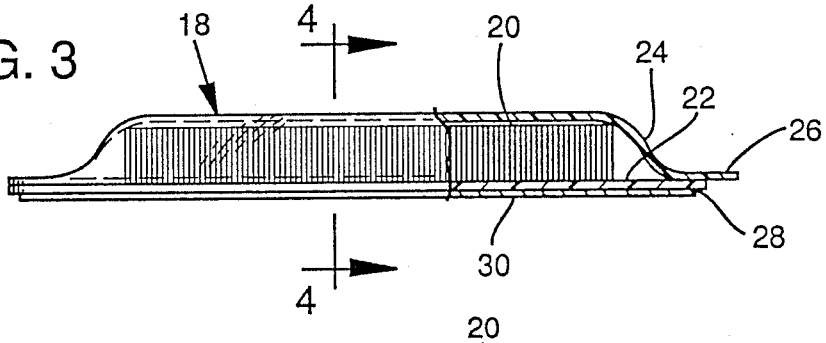
FIG. 3 is a side elevational view, partly broken away of the emergency staple pack.
Figure 4:
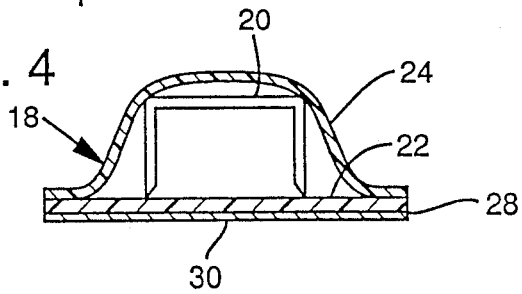
FIG. 4 is an enlarged cross sectional view taken on the line 4—4 of FIG. 3.

With particular reference to the drawings, the invention has particular adaptation to a hand stapler 10 of the type best shown in FIG. 1, comprising a base portion 12, a hinged pusher arm 14 that encloses a strip of staples, and an anvil 16 on the base engaged by the staples as the pusher arm 14 is pivoted downwardly in a stapling operation.

The present invention resides in an emergency pack 18 arranged to hold a single strip 20 of staples on the stapler itself so that it is conveniently available in the event that the operator has a fast need for staples. The emergeny pack comprises a bottom wall or base 22 or the like, such as cardboard, on which is supported the strip of staples 20. In a preferred packaged arrangement, the staples are enclosed in a clear plastic bubble pack or skin 24 such as by a vacuum pack procedure. It is desired that one end of the bubble pack 24, such as the rearward portion thereof, be extended beyond the base portion 22 in order to form a finger tab 26 which allows the covering portion 24 to be pulled away from the base for removal of the staples. The lower surface of the base portion 22 is provided with a non-setting adhesive 28 which is capable of attaching the pack to a surface of the stapler. The adhesive 28 is of well known use which while providing a good attachment of the pack to a surface of the stapler nevertheless allows the pack to be removed and another pack to be substituted therefor. For the purpose of shipment and storage, the lower adhesive surface 28 is covered with a removable protective layer 30 such as a sheet of thin paper or plastic.

In use, it is preferred that the emergency staple pack be stuck to a surface of the stapler and particularly in piggyback manner to the top surface thereof since such surface is generally flat. Importantly, the lateral and longitudinal dimensions of the base member 22 are selected such that it will fit on the usual stapler and preferably its dimensions are minimized so as to be confined within the dimensions of the top surface of the stapler. The length thereof is considerably less than the length of the stapler push arm whereby it will not interfere with the pressing surface of the pusher arm which is usually in the area immediately above the anvil 16.

According to the invention, an emergency supply of staples is conveniently available. The emergency pack will adhere to the stapler without interferring with the operation of the stapler but on the other hand can be readily removed for replacement when necessary.

The stapler pack is readily opened by pulling the finger tab 26. Furthermore, the stapler does not need alteration of any kind. Also, the present pack is adaptable to existing staplers. Advertising material 32 may be printed or otherwise displayed on the bubble pack 24.

It is to be understood that the form of my invention herein shown and described is to be taken as a preferred example of the same and that various changes in the shape, size and arrangement of parts may be resorted to without departing from the spirit of my invention, or the scope of the subjoined claims. For example, the emergency pack 18, while designed particularly for adherence to a stapler surface, could as well be attached to an inner drawer surface, inner briefcase surface, or other conveniently available surface near the stapler.

Having thus described my invention, I claim:

1. In combination, a stapler having a base portion, a pivoted hand operated pusher arm on said base portion with top and side surface portions, an emergency staple pack comprising a bottom wall having upper and lower surfaces and end portions and being arranged to support a single strip of staples on said upper surface thereof for use as an emergency supply, enclosure means on said bottom wall enclosing a single strip of staples, a non-setting adhesive on the lower surface of said bottom wall arranged to temporarily attach said staple pack to one of said surface portions of the stapler, said bottom wall being dimensioned selectively relative to the surface portions of the pusher arm such that when attached to one said surface portions it is confined within the dimensions of said one of said surface portions.

2. The combination of claim 1 wherein said enclosure means is removable to provide access to the strip of staples therein, said enclosure means comprising a bubble pack type of enclosure and having a pull tab extending beyond an end portion of said bottom wall arranged to be readily grasped to pull said enclosure means away from said bottom wall for removal of the strip of staples.

* * * * *